US007456797B2

(12) United States Patent
Francque et al.

(10) Patent No.: US 7,456,797 B2
(45) Date of Patent: Nov. 25, 2008

(54) ANTENNA SYSTEM WITH PARASITIC ELEMENT AND ASSOCIATED METHOD

(75) Inventors: Craig Francque, Derby, KS (US); Phillip A. Lindsey, Atlanta, KS (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 12/035,810

(22) Filed: Feb. 22, 2008

(65) Prior Publication Data

US 2008/0143618 A1 Jun. 19, 2008

Related U.S. Application Data

(62) Division of application No. 11/100,116, filed on Apr. 6, 2005, now Pat. No. 7,382,330.

(51) Int. Cl.
*H01Q 1/32* (2006.01)
*H01Q 21/00* (2006.01)

(52) U.S. Cl. ..... 343/713; 343/835; 343/836

(58) Field of Classification Search ..... 343/705, 343/711, 713, 815, 83, 834, 935, 836, 844
See application file for complete search history.

(56) References Cited

U.S. PATENT DOCUMENTS 4,186,400 A 1/1980 Cermignani et al.
5,889,491 A * 3/1999 Minter ..... 342/174
6,606,057 B2 8/2003 Chiang et al.
6,751,442 B1 * 6/2004 Barrett ..... 455/11.1
6,844,854 B2 1/2005 Johnson et al.
6,894,653 B2 5/2005 Chiang et al.
2006/0038736 A1 2/2006 Hui et al.

* cited by examiner

*Primary Examiner*—Tan Ho
(74) *Attorney, Agent, or Firm*—Alston & Bird LLP

(57) ABSTRACT

An antenna system comprises a parasitic element, which is an electrically tuned structural element, installed between antennas to reduce or eliminate antenna-to-antenna coupled electromagnetic interference by emitting destructive interference in the direction from one antenna to another antenna. The antenna system comprises a first antenna operating at a first wavelength, a second antenna operating at a second wavelength, and a parasitic element located between the first antenna and the second antenna for reducing the amplitude of signals from the first antenna that would otherwise create electromagnetic interference in a receiver connected to the second antenna. The parasitic element is typically spaced from the first antenna by a distance substantially equal to one quarter of the first wavelength. The parasitic element generally has a height that is greater than the height of the first antenna.

20 Claims, 5 Drawing Sheets

ANTENNA SYSTEM WITH PARASITIC ELEMENT AND ASSOCIATED METHOD

CROSS-REFERENCE TO RELATED APPLICATION

This is a divisional of U.S. application Ser. No. 11/100,116, filed Apr. 6, 2005 now U.S. Pat. No. 7,382,330, the contents of which are incorporated herein in their entirety by reference.

FIELD OF THE INVENTION

The present invention is related to antenna systems, and more particularly, to an improved antenna system that reduces electromagnetic interference between antennas.

BACKGROUND OF THE INVENTION

In recent years, wireless communications systems have become common and the number of different types of communications systems has greatly increased. This is particularly true for commercial and military aircraft. In addition to communications systems, other types of wireless systems such as navigation and surveillance systems are common. Wireless systems require antennas to operate. Since the number of wireless systems has greatly increased there has been a corresponding increase in the number of antennas. Where a large number of antennas are required to be used in a small area, such as on a vehicle, problems with electromagnetic interference (EMI) can result.

New communications, navigation, and surveillance avionics systems are rapidly being added to aircraft. In commercial and general aviation aircraft, for example, high speed and large bandwidth communications systems that provide internet access and satellite television are being added. The trend in both military and commercial aircraft to add more communications and avionics systems is expected to continue, which in turn will likely cause an increase in the number of antennas. Given the limited external surface area of aircraft, as well as the aerodynamic considerations, a larger number of antennas necessarily means the antennas must be mounted closer together.

This increasing density of the antenna suite makes it more difficult to maintain inter-system electromagnetic compatibility. Antenna-to-antenna coupled EMI becomes an increasingly difficult issue. On some aircraft, for example, simultaneous operation of multiple avionics systems is currently not achievable because of EMI. This density of the antenna suite also makes it more difficult to successfully implement the traditional techniques for reducing EMI to more manageable levels.

Prior techniques for reducing or eliminating antenna-to-antenna coupled EMI include physically separating the antennas by a distance that ensures adequate space loss, installing radio frequency (RF) filters, frequency management, or installing interference blanking systems. As the density of the aircraft antenna suite continues to increase, selecting antenna locations that provide adequate space loss may not be possible. In addition, traditional RF filter solutions are typically not applicable for the in-band interference condition, while filter performance for out-of-band interference applications may not provide enough attenuation in the stopband, or the transition band roll-off characteristic may not provide the required attenuation. Moreover, frequency management techniques limit the flexibility of system operations and may not be an acceptable alternative from the user's perspective, while interference blanking systems are inherently complex and do not provide for simultaneous multiple system operations. The blanking systems may also be cost prohibitive. As more communications and avionics systems are added to aircraft, maintaining inter-system compatibility using other traditional techniques for reducing EMI may become cost prohibitive. In addition, the density of the antenna suite may increase to the point where the traditional techniques for reducing EMI are simply not capable of preventing antenna-to-antenna coupled EMI.

While the problem of antenna-to-antenna coupled EMI is particularly acute on aircraft, this problem exists on other types of vehicles as well as stationary structures having dense antenna suites. Therefore it would be desirable to have an improved antenna system whereby antenna-to-antenna coupled EMI is reduced or eliminated.

BRIEF SUMMARY OF THE INVENTION

An antenna system is therefore provided whereby a parasitic element, which is an electrically tuned structural element, is installed between antennas to reduce or eliminate antenna-to-antenna coupled EMI by emitting destructive interference in the direction from one antenna to another antenna. In this regard, the antenna system comprises a first antenna operating at a first wavelength, a second antenna operating at a second wavelength, and a parasitic element located between the first antenna and the second antenna for reducing the amplitude of signals from the first antenna that would otherwise create electromagnetic interference in a receiver connected to the second antenna. The parasitic element may have a height that is greater than a height of the first antenna. The parasitic element may be spaced from the first antenna by a distance substantially equal to one quarter of the first wavelength.

In one embodiment, the parasitic element may have a height that is greater than a height of the second antenna. The parasitic element may be spaced from the second antenna by a distance substantially equal to one quarter of the second wavelength.

In another embodiment in which the parasitic element is a first parasitic element, the antenna system may further comprise a second parasitic element. The first parasitic element may have a height that is greater than a height of the first antenna, and the second parasitic element may have a height that is greater than a height of the second antenna. The first parasitic element may be spaced from the first antenna by a distance substantially equal to one quarter of the first wavelength and the second parasitic element may be spaced from the second antenna by a distance substantially equal to one quarter of the second wavelength.

In one embodiment, the first wavelength may be the same as the second wavelength. In an alternative embodiment, the first wavelength may be different than the second wavelength. In another alternative embodiment, the first antenna may be operating at a plurality of wavelengths. The parasitic element may comprise a cylinder. Alternatively, the parasitic element may have a planar shape, such as rectangular or trapezoidal. A planar parasitic element may be photo-etched on a dielectric substrate. The parasitic element may be encased by a foam filled dielectric cover having an aerodynamic shape.

In one embodiment, the antenna system may comprise a plurality of antennas operating at a plurality of respective wavelengths and a plurality of parasitic elements located between at least two of the plurality of antennas and the second antenna.

The antenna system of the present invention may be mounted on a vehicle, most preferably an aircraft. In one embodiment of the invention, a vehicle system comprises a vehicle body and any of the antenna systems described in this application. The vehicle body may comprise an aircraft, motor vehicle, a ship, or any other type of vehicle. A vehicle system may comprise a vehicle body, a first antenna mounted on the vehicle body operating at a first wavelength, a second antenna mounted on the vehicle body operating at a second wavelength, and a parasitic element mounted on the vehicle body located between the first antenna and the second antenna for reducing the amplitude of signals from the first antenna that would otherwise create electromagnetic interference in a receiver connected to the second antenna.

BRIEF DESCRIPTION OF THE SEVERAL VIEWS OF THE DRAWING(S)

DETAILED DESCRIPTION OF THE INVENTION

The present invention now will be described more fully with reference to the accompanying drawings, in which some, but not all embodiments of the invention are shown. This invention may be embodied in many different forms and should not be construed as limited to the embodiments set forth. Like numbers refer to like elements throughout.

The present invention is an improved antenna system whereby a parasitic element, which is an electrically tuned structural element, is installed between antennas to reduce or eliminate antenna-to-antenna coupled EMI. The radiated fields of one antenna, called an emitter antenna, excite the parasitic element and create a current distribution in the parasitic element, thereby creating other radiated fields. The radiated fields from the parasitic element in the direction from the parasitic element toward the receptor antenna are out of phase with the radiated fields from the emitter antenna in the direction from the parasitic element toward the receptor antenna. When the radiated fields from the parasitic element combine with the radiated fields from the emitter antenna, the resulting combined radiated fields have reduced amplitudes compared to the radiated fields from the emitter. As a result, the energy coupled in the direction of a second antenna, called a receptor antenna, is significantly reduced. This reduction of energy in the direction of the receptor antenna reduces the potential for EMI between the two antennas. The presence of the parasitic element, however, has minimal effect on the installed far field radiation pattern of the antennas and therefore has a minimal effect on antenna performance.

Figure 1:
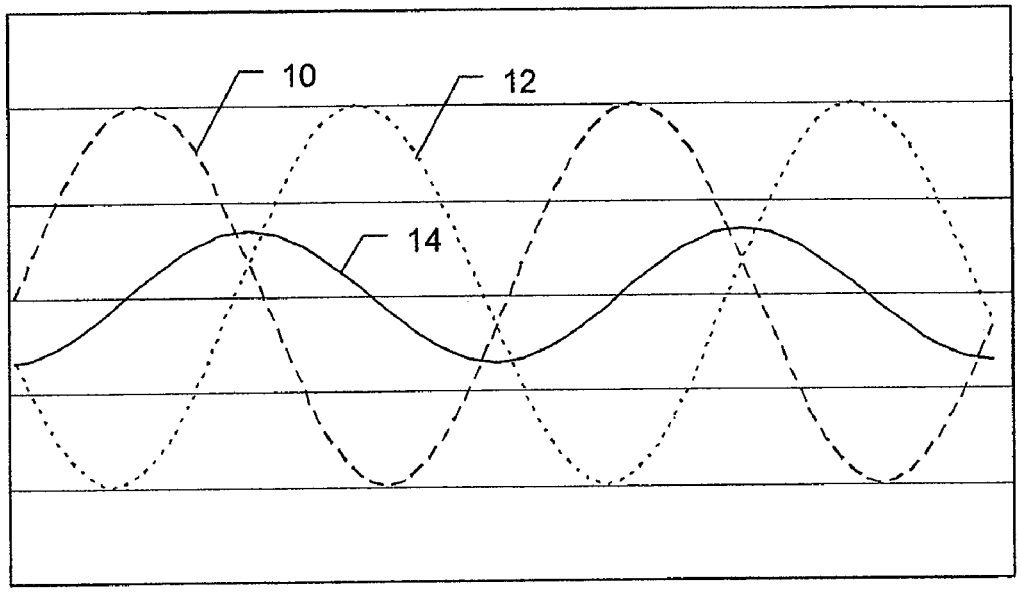
FIG. 1 is a graph of signals within an antenna system in accordance with the present invention.

FIG. 1 illustrates signals within an antenna system of the present invention. Signal 10 illustrates a signal that may be transmitted from an emitter antenna. If the antenna system comprised an emitter antenna and a receptor antenna without a parasitic element, signal 10 would typically arrive at the receptor antenna with substantially the same amplitude as shown in FIG. 1. A signal with the amplitude of signal 10 arriving at the receptor antenna may cause EMI in a receiver connected to the receptor antenna. When a parasitic element is located between the emitter antenna and the receptor antenna, a current distribution may be created in the parasitic element as discussed above, causing the parasitic element to transmit signal 12. Signal 12 is out of phase with signal 10. As such, signal 12 combines with signal 10 in the direction from the parasitic element toward the receptor antenna. Because signal 12 is out of phase with signal 10, the resulting combined signal 14 has a reduced amplitude. The combination of signal 12 and signal 10 resulting in a signal with a reduced amplitude may be termed destructive interference. This reduction in amplitude of the signal arriving at the receptor antenna reduces the potential for EMI in a receiver connected to the receptor antenna. This reduction in amplitude occurs only in the direction from the parasitic element toward the receptor antenna. In other directions, particularly from the parasitic element toward the emitter antenna, signal 10 and signal 12 would typically combine to produce a resulting signal with an increased amplitude.

The emitter antenna is denoted as such because it is the source of the EMI radiated toward the receptor antenna, and the receptor antenna is denoted as such because it receives the EMI radiated from the emitter antenna. An antenna that is connected to a transmitter cannot receive EMI, and therefore would not be denoted as a receptor antenna. An antenna that is connected to a transceiver may be the source of EMI radiated toward one antenna while at a different point in time may receive EMI radiated from another antenna. Therefore, an antenna that is connected to a transceiver may be denoted as both an emitter antenna and a receptor antenna, depending on whether the transceiver connected to such an antenna was in the transmit mode or the receive mode.

An antenna functioning as an emitter will radiate a signal at one fundamental frequency at a point in time, depending on the frequency that has been selected in the radio frequency (RF) transmitter. Similarly, an antenna functioning as a receptor will receive a signal at one fundamental frequency at a point in time, depending on the frequency that has been selected at the RF receiver. In addition to the fundamental frequency, each emitter antenna radiates harmonics of the fundamental frequency as well as spurious emissions simultaneously with the selected fundamental frequency. As such, an emitter antenna radiates multiple frequencies simultaneously.

The parasitic element is electrically tuned by controlling its height and controlling the spacing between the element and the antennas. These dimensions may also be selected in a manner that affects both in-band and out-of-band interference. The parasitic element provides the largest reduction of the amplitude of a signal for which the parasitic element is tuned (termed the tuned frequency), with less reduction of the amplitude of signals at other frequencies. The parasitic element will simultaneously produce destructive interference for the tuned frequency and other frequencies, including frequencies above and below the tuned frequency.

Figure 2:
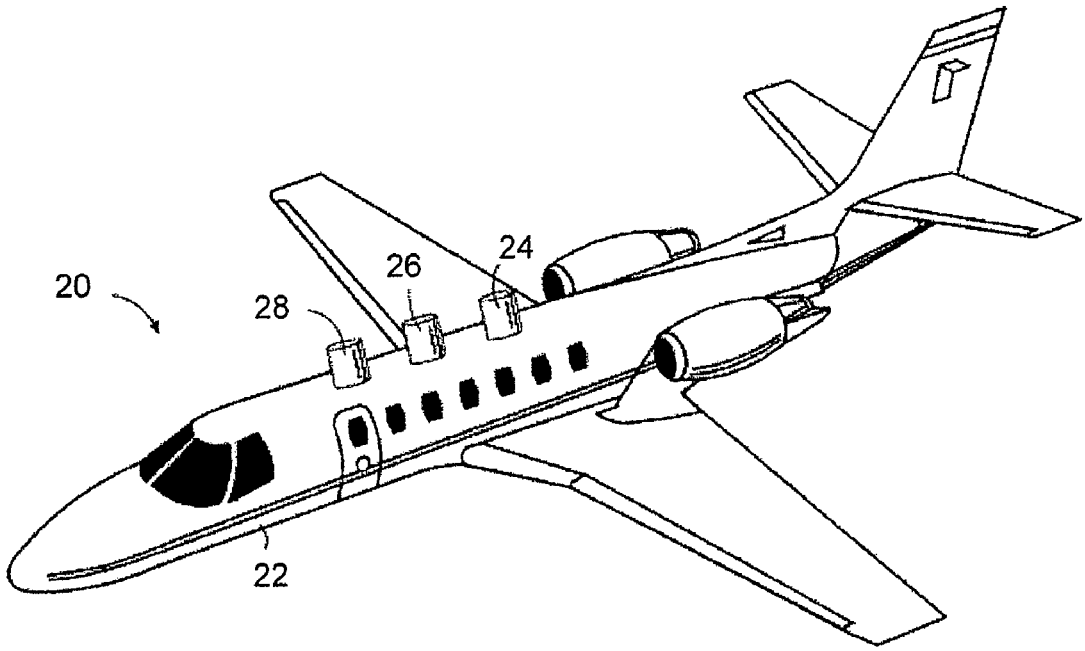
FIG. 2 is a perspective view of a vehicle system in accordance with the present invention.

FIG. 2 illustrates a perspective view of a vehicle system 20 in accordance with one embodiment of the present invention. According to the depicted embodiment, the vehicle system 20 comprises a vehicle body 22, an emitter antenna 24, a receptor antenna 28, and a parasitic element 26. Emitter antenna 24, receptor antenna 28, and parasitic element 26 may all be encased in a foam filled dielectric cover having an aerodynamic shape, such as the blade-like shape in FIG. 2. In this embodiment, the vehicle system is an aircraft, although other vehicle systems as well as other stationary structures may employ the present invention. Emitter antenna 24 transmits signals having a first wavelength or a plurality of first wavelengths. Receptor antenna 28 is configured to receive signals having a second wavelength, such that the second wavelength may be the same as or different than the first wavelength. Parasitic element 26 is mounted on vehicle body 22 and is located between emitter antenna 24 and receptor antenna 28, such that parasitic element 26 reduces the amplitude of signals from emitter antenna 24 that would otherwise create EMI in a receiver connected to receptor antenna 28. Typically, parasitic element 26 would be located on a line between emitter antenna 24 and receptor antenna 28, although the parasitic element 26 may be slightly displaced on either side of such a line if desired. However, such a displacement from the line between the emitter antenna and the receptor antenna would likely reduce the amount of EMI reduction that could otherwise be achieved if the parasitic element is located on the line.

Figure 3:
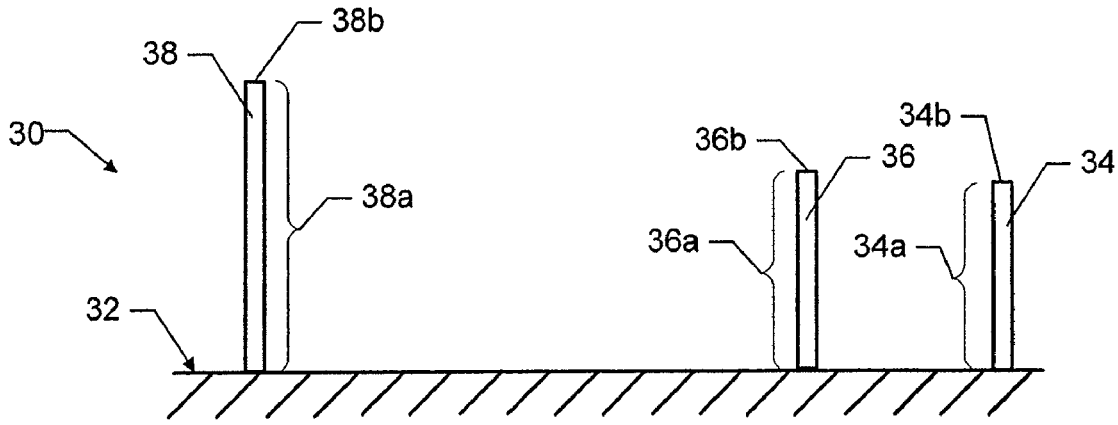
FIG. 3 is a side planar view of an antenna system in accordance with the present invention, illustrating a single parasitic element to reduce the amplitude of signals from a single antenna.

FIG. 3 illustrates a side planar view of an antenna system 30 such as described in accordance with FIG. 2. Antenna system 30 comprises an emitter antenna 34, a receptor antenna 38, and a parasitic element 36, all mounted on a surface 32 such as a vehicle body. Typically, the parasitic element 36 would be spaced from the emitter antenna 34 by a distance substantially equal to one quarter of a wavelength of the signal being transmitted by the emitter antenna 34. The distance between the emitter antenna and the parasitic element may vary. As the distance between the parasitic element and the emitter antenna is increased, the voltage standing wave ratio (VSWR) improves, such that a distance of three sixteenths of a wavelength or greater would typically provide a desirable VSWR. However, as the distance between the emitter antenna and the parasitic element is decreased, greater reduction of EMI is achieved, such that a distance of one eighth or one quarter of a wavelength would typically provide a desirable amount of EMI reduction. Additionally, the distance between the emitter antenna and the parasitic element may affect radiation pattern performance. As such, selecting the distance between the emitter antenna and the parasitic element generally involves balancing emitter antenna VSWR, radiation pattern performance, and EMI reduction. A distance of one quarter of a wavelength typically provides a desirable VSWR, desirable radiation pattern performance, and a desirable amount of EMI reduction.

In this embodiment in which the parasitic element is spaced one quarter wavelength away from the emitter antenna, the parasitic element 36 would typically have a height 36*a* that is greater than one quarter of a wavelength of the lowest fundamental frequency being transmitted by the emitter antenna 34. The height 36*a* of the parasitic element 36 would typically be measured from the distal end 36*b* to the mounting surface 32. Emitter antenna 34 typically has a height 34*a* that is substantially equal to one quarter of a wavelength of the lowest fundamental frequency being transmitted by the emitter antenna 34. The height 34*a* of the emitter antenna 34 would typically be measured from the distal end 34*b* to the mounting surface 32. As such, the parasitic element 36 typically has a height 36*a* that is greater than the height of the emitter antenna 34. If the height of the parasitic element is less than the height of the emitter antenna, then the parasitic element may increase the amplitude of the signal toward the receptor antenna and thus provide an undesirable result.

The parasitic element 36 may be cylindrical in shape, such as a circular cylinder or an elliptical cylinder. A parasitic element that has a circular cylindrical shape may have a diameter of five to ten millimeters. The parasitic element may also be planar shaped, as illustrated in FIGS. 7A-7E. The parasitic element may have a number of different shapes, depending on the desired performance characteristics, and will typically be encased in an aerodynamically shaped dielectric cover. However, the parasitic element may be blade shaped, wherein such a parasitic element would have an aerodynamic shape and as such may not be encased in a foam-filled dielectric cover. The parasitic element may be any type of structure that receives a signal from one antenna and emits destructive interference in the direction of another antenna. The parasitic element would typically be mounted on the outer skin of a vehicle, such as an aircraft, such that the parasitic element is perpendicular to the skin of the vehicle, however other mounting configurations may be used. The parasitic element 36 is typically comprised of an electrically conductive material, such as copper.

Figure 4:
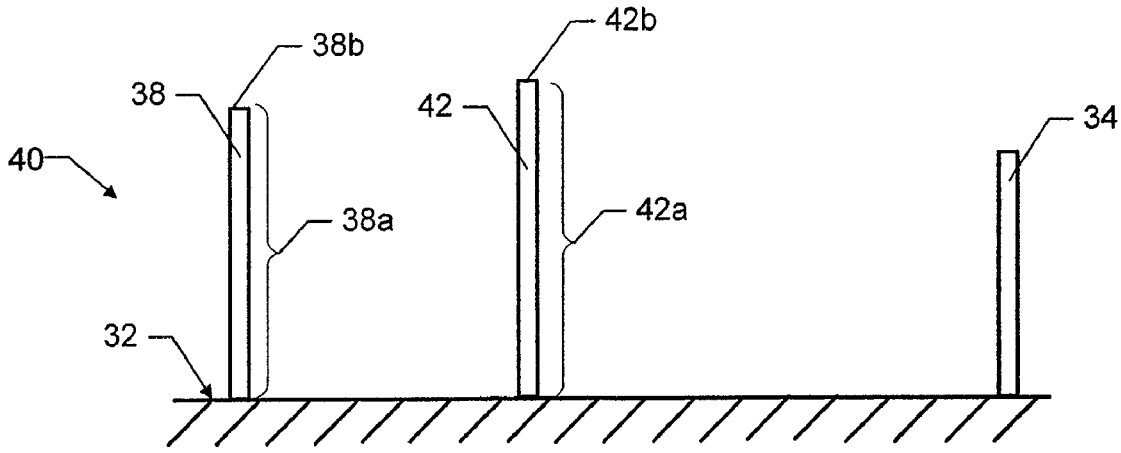
FIG. 4 is a side planar view of an antenna system in accordance with the present invention, illustrating a single parasitic element to reduce the amplitude of signals from a single antenna.

FIG. 4 illustrates a side planar view of an antenna system 40 in accordance with another embodiment of the present invention. According to the depicted embodiment, the antenna system 40 comprises an emitter antenna 34, a receptor antenna 38, and a parasitic element 42. In this embodiment, parasitic element 42 may be spaced a distance away from the receptor antenna 38 that is substantially equal to one quarter wavelength of the lowest fundamental frequency being received by the receptor antenna 38. In this embodiment, the height of the parasitic element 42 would typically be greater than the height of the receptor antenna 38, rather than being greater than the height of the emitter antenna as in the system of FIG. 3. The height 38*a* of the receptor antenna 38 would typically be measured from the distal end 38*b* to the mounting surface 32.

Figure 5:
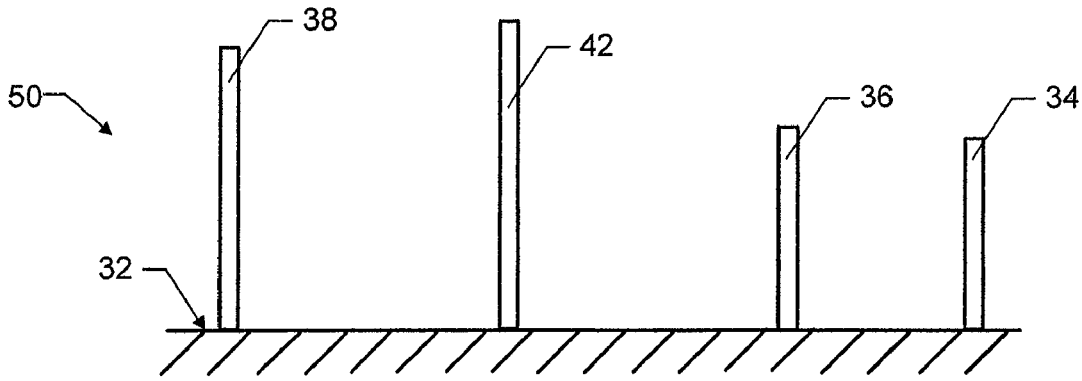
FIG. 5 is a side planar view of an antenna system in accordance with the present invention, illustrating two parasitic elements to reduce the amplitude of signals from a single antenna.

FIG. 5 illustrates a side planar view of an antenna system 50 in accordance with another embodiment of the present invention. According to the depicted embodiment, the antenna system 50 comprises an emitter antenna 34, a receptor antenna 38, a first parasitic element 36, and a second parasitic element 42. In this embodiment, first parasitic element 36 is typically spaced a distance away from the emitter antenna 34 that is substantially equal to one quarter wavelength of the lowest fundamental frequency being transmitted by the emitter antenna 34. Second parasitic element 42 may be spaced a distance away from the receptor antenna 38 that is substantially equal to one quarter wavelength of the lowest fundamental frequency being received by the receptor antenna 38. In this embodiment, the height of the first parasitic element 36 would typically be greater than the height of the emitter antenna 34, and the height of the second parasitic element 42 would typically be greater than the height of the receptor antenna 38. The antenna system of FIG. 5, having two parasitic elements, may reduce the amplitude of the signal from the emitter antenna 34 by as much as twice as much as the antenna system of FIG. 3 or the antenna system of FIG. 4.

Figure 6:
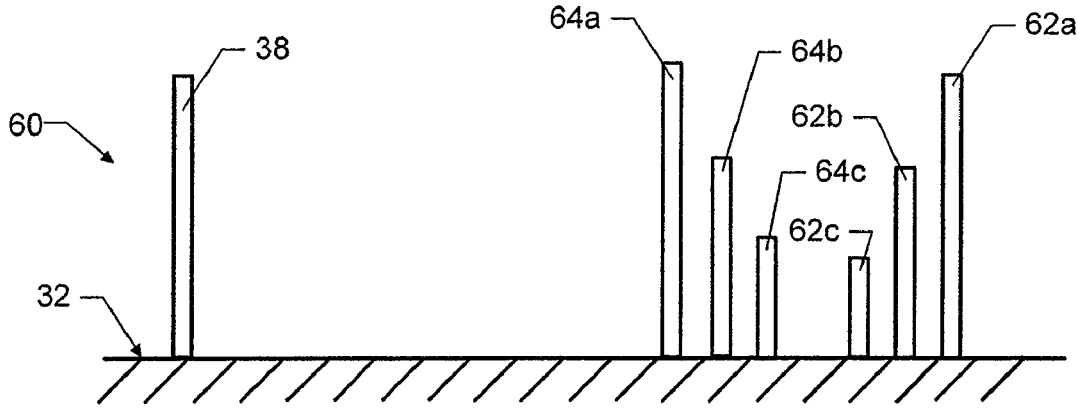
FIG. 6 is a side planar view of an antenna system in accordance with the present invention, illustrating a plurality of parasitic elements to reduce the amplitude of signals from a plurality of antennas.

While a single antenna can emit signals having multiple wavelengths, an antenna system can include multiple emitter antennas, each emitting a different wavelength. See FIG. 6 in which antenna system 60 has three emitter antennas 62*a*, 62*b*, and 62*c*, each emitting a different wavelength. In this instance, there are three parasitic elements 64*a*, 64*b*, and 64*c* reducing the amplitude of signals from emitter antennas 62*a*, 62*b*, and 62*c*, respectively.

Although FIGS. 3-6 show antennas as end fed quarter wavelength monopoles over a ground plane, embodiments of the present invention may include other types of antennas.

In addition to the cylindrical parasitic elements illustrated in FIG. 3-6, FIGS. 7A-7E illustrate alternative embodiments of parasitic elements having planar shapes. A parasitic element having a planar shape would generally be positioned between an emitter antenna and a receptor antenna such that the plane of the parasitic element would be aligned with the line between the emitter antenna and the receptor antenna. A parasitic element having a planar shape may reduce the amplitude of a plurality of signals having a plurality of wavelengths. A parasitic element having a planar shape may reduce the amplitude of signals having a larger number of differing wavelengths than would be typically reduced by a cylindrical parasitic element. As such, parasitic elements having a planar shape may be said to have a larger effective bandwidth than cylindrical parasitic elements. A larger effective bandwidth is generally desirable because the emitter antenna will typically transmit signals having a plurality of different wavelengths. Additionally, a parasitic element having a planar shape may provide a greater reduction of the signal from the emitter antenna than provided by a cylindrical parasitic element. As such, a parasitic element having a planar shape may provide reduced antenna-to-antenna EMI coupling. The planar shape of a parasitic element may vary as discussed below. The conductive portion of the parasitic element would typically be comprised of copper and would be photo-etched onto a dielectric substrate.

Figure 7A:
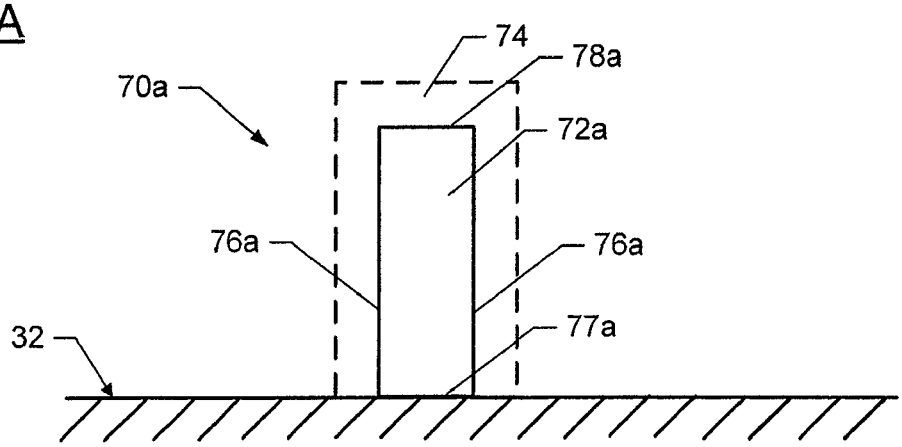
FIGS. 7A-7E are side planar views of parasitic elements having planar shapes in accordance with the present invention.

FIG. 7A illustrates one embodiment of a planar parasitic element. The parasitic element 70*a* of FIG. 7A comprises a conductive portion 72*a* on a dielectric substrate 74. The conductive portion 72*a* is generally rectangular, such that top edge 78*a* is substantially parallel to bottom edge 77*a* (and to mounting surface 32) and side edges 76*a* are substantially parallel to each other. Such a rectangular planar parasitic element may have an increased effective bandwidth and reduced EMI coupling.

Figure 7B:
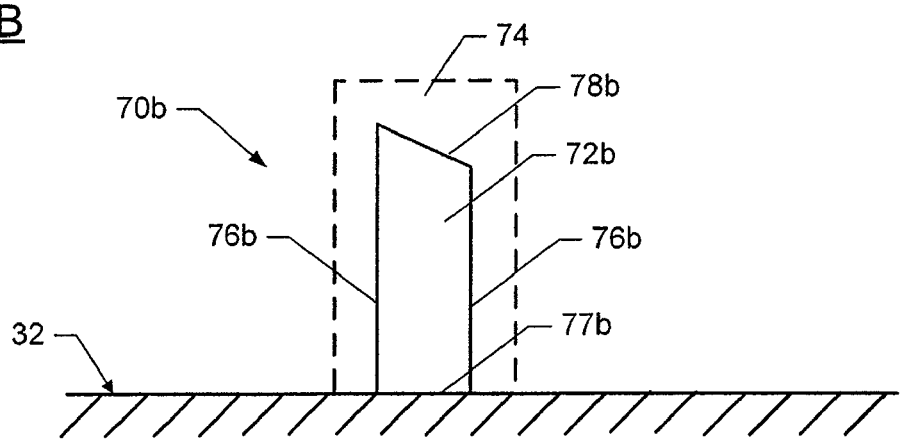

FIG. 7B illustrates another embodiment of a planar parasitic element. The conductive portion 72*b* of parasitic element 70*b* is generally trapezoidal, such that side edges 76*b* are substantially parallel to each other but top edge 78*b* is not parallel to bottom edge 77*b*. Rather, top edge 78*b* is angled such that the height of the side edge that is closer to the emitter antenna is less than the height of the side edge that is closer to the receptor antenna. Such a trapezoidal planar parasitic element having an angled top edge may have an increased effective bandwidth and reduced EMI coupling.

Figure 7C:
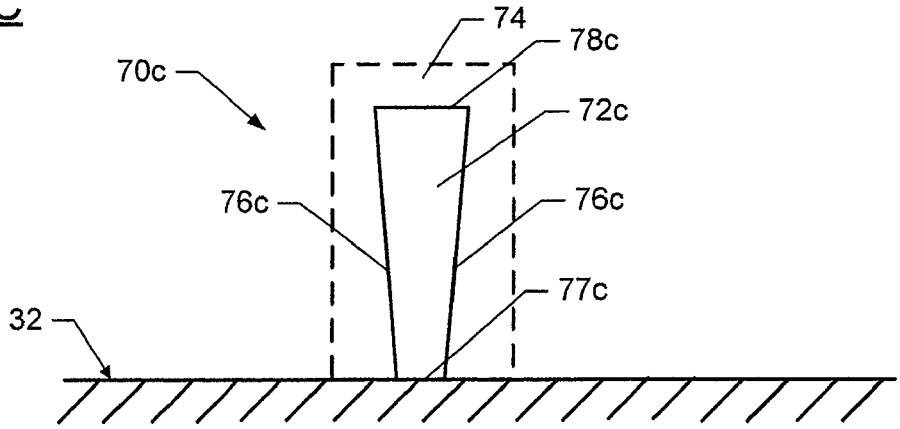

FIG. 7C illustrates another embodiment of a planar parasitic element. The conductive portion 72*c* of parasitic element 70*c* is also generally trapezoidal. Top edge 78*c* is substantially parallel to bottom edge 77*c*. Side edges 76*c* are angled toward the center of the conductive portion such that the top edge 78*c* is longer than the bottom edge 77*c*. Such a trapezoidal planar parasitic element having angled side edges may have an increased effective bandwidth and reduced EMI coupling.

Figure 7D:
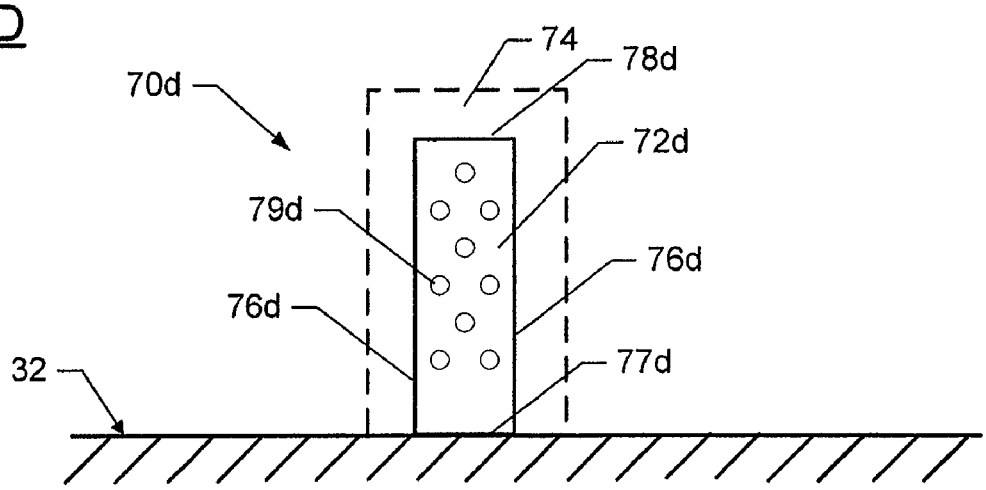

FIG. 7D illustrates another embodiment of a planar parasitic element. The conductive portion 72*d* is generally rectangular, as in the parasitic element of FIG. 7A. However, the conductive portion 72*d* of the parasitic element of FIG. 7D defines a plurality of perforations within the planar surface. Such a rectangular planar parasitic element may have an increased effective bandwidth and reduced EMI coupling. The perforations increase edge diffraction and may result in further reductions in EMI coupling. Such perforations may be used in any of the planar parasitic elements of FIGS. 7A-7E, with similar additional reductions in EMI coupling.

Figure 7E:
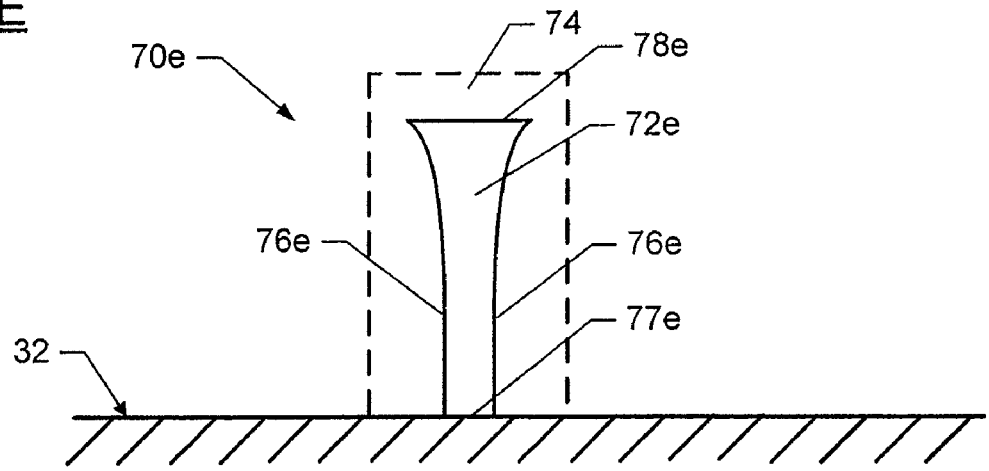

FIG. 7E illustrates another embodiment of a planar parasitic element. The conductive portion 72*e* has a similar shape to that of the conductive portion 72*c* of FIG. 7C. However, the side edges 76*e* of FIG. 7E curve toward the center of the conductive portion. Such a planar parasitic element having curved side edges may have an increased effective bandwidth and reduced EMI coupling.

In addition, each antenna and each parasitic element is generally encased in a foam filled dielectric material. The foam filled dielectric material is generally found to have an aerodynamic shape, such as a blade shape, to provide low wind resistance. The parasitic element is generally comprised of an electrically conductive material such as copper. The parasitic element is generally grounded to the aircraft skin with a metallic base plate.

By reducing the amplitude of signals from the emitting antennas, there is less interference at the receiver connected to the receptor antenna, thus the antennas can be mounted closer together without EMI degrading the performance of the receivers. The present invention has many advantages over the traditional EMI fixes. Both in-band as well as out-of-band antenna-to-antenna coupled EMI can be significantly reduced or may be eliminated. Implementation of the present invention requires relatively minor structural modification of the vehicle. Design and implementation of the structure is relatively simple and inexpensive.

The invention is not limited to the specific disclosed embodiments. Although specific terms are employed, they are used in a generic and descriptive sense only and not for purposes of limitation.

That which is claimed:

1. A vehicle system comprising:

a vehicle body;

a first antenna carried by the vehicle body and operating at a first wavelength;

a second antenna carried by the vehicle body and operating at a second wavelength;

a first parasitic element located between the first antenna and the second antenna for reducing the amplitude of signals from the first antenna that would otherwise create electromagnetic interference in a receiver connected to the second antenna, wherein the first parasitic element has a height that is greater than a height of the first antenna; and a second parasitic element carried by the vehicle body and having a height that is greater than a height of the second antenna.

2. A vehicle system of claim 1, wherein the vehicle body is an aircraft.

3. The vehicle system of claim 1, wherein the first parasitic element is spaced from the first antenna by a distance substantially equal to one quarter of the first wavelength.

4. The vehicle system of claim 1, wherein the first parasitic element has a height that is greater than a height of the second antenna.

5. The vehicle system of claim 4, wherein the first parasitic element is spaced from the second antenna by a distance substantially equal to one quarter of the second wavelength.

6. The vehicle system of claim 1, wherein the first parasitic element is spaced from the first antenna by a distance substantially equal to one quarter of the first wavelength and wherein the second parasitic element is spaced from the second antenna by a distance substantially equal to one quarter of the second wavelength.

7. The vehicle system of claim 1, wherein the first wavelength is the same as the second wavelength.

8. The vehicle system of claim 1, wherein the first wavelength is different than the second wavelength.

9. The vehicle system of claim 1, wherein the first antenna is operating at a plurality of wavelengths.

10. The vehicle system of claim 1, wherein the first parasitic element comprises a cylinder.

11. The vehicle system of claim 1, wherein the first parasitic element has a planar shape selected from the group comprising rectangular and trapezoidal.

12. The vehicle system of claim 11, wherein the first parasitic element is photo-etched on a dielectric substrate.

13. A vehicle system comprising:

a vehicle body;

a plurality of antennas carried by the vehicle body and operating at a plurality of respective wavelengths;

a second antenna carried by the vehicle body and operating at a second wavelength; and a plurality of parasitic elements located between at least two of the plurality of antennas and the second antenna for reducing the amplitude of signals from the at least two of the plurality of antennas that would otherwise create electromagnetic interference in a receiver connected to the second antenna.

14. The vehicle system of claim 13, wherein the vehicle body is an aircraft.

15. The vehicle system of claim 13, wherein the plurality of antennas include a first antenna operating at a first wavelength, wherein the plurality of parasitic elements include a first parasitic element located between the first antenna and the second antenna, and wherein the first parasitic element is spaced from the first antenna by a distance substantially equal to one quarter of the first wavelength.

16. The vehicle system of claim 15, wherein the first parasitic element has a height that is greater than a height of the second antenna.

17. The vehicle system of claim 16, wherein the first parasitic element is spaced from the second antenna by a distance substantially equal to one quarter of the second wavelength.

18. The vehicle system of claim 15, wherein the first parasitic element is spaced from the first antenna by a distance substantially equal to one quarter of the first wavelength and wherein the second parasitic element is spaced from the second antenna by a distance substantially equal to one quarter of the second wavelength.

19. The vehicle system of claim 13, wherein the plurality of parasitic elements comprise cylinders.

20. The vehicle system of claim 13, wherein each of the plurality of parasitic elements has a planar shape selected from the group comprising rectangular and trapezoidal.

* * * * *